US006213901B1

(12) United States Patent
Collinson

(10) Patent No.: US 6,213,901 B1
(45) Date of Patent: Apr. 10, 2001

(54) LACROSSE STICK STRING CONFIGURATION

(75) Inventor: William Collinson, Harwood, MD (US)

(73) Assignee: East Coast Lacrosse Ltd., Harwood, MD (US)

( * ) Notice: Subject to any disclaimer, the term of this patent is extended or adjusted under 35 U.S.C. 154(b) by 0 days.

(21) Appl. No.: 09/241,869

(22) Filed: Feb. 2, 1999

(51) Int. Cl.[7] ..... A63B 59/02; A63B 65/12
(52) U.S. Cl. ..... 473/513
(58) Field of Search ..... 473/513

(56) References Cited

U.S. PATENT DOCUMENTS

| | | | | |
|---|---|---|---|---|
| 2,039,138 | | 4/1936 | Auer . | |
| 2,142,527 | | 1/1939 | Pool . | |
| 3,507,495 | | 4/1970 | Tucker et al. . | |
| 3,910,578 | * | 10/1975 | Brine, Jr. | 473/513 |
| 4,049,273 | * | 9/1977 | Pool | 473/513 |
| 4,097,046 | * | 6/1978 | Friant | 473/513 |
| 4,861,042 | | 8/1989 | Trettin . | |
| 4,938,480 | | 7/1990 | Lods . | |
| 5,048,843 | * | 9/1991 | Dorfi et al. | 473/513 |

OTHER PUBLICATIONS

Dyed Heads Page–http://www.bravelacrosse.com/Dye%20Heads/dyed_heads_page.asp—pp. 1–14; page 4, Jul. 18, 2000.*

Lacrosse Stick Tech Workshop–http://www.e–lacrosse.com/stech9.html–pp. 1–12; pp. 1,3, May 1, 1999.*

Lacrosse Stick Tech Workshop–http://www.e–lacrosse.com/stech3.htlm–pp. 1–5; pp. 1,3, Sep. 1, 1998.*

* cited by examiner

*Primary Examiner*—Jeanette Chapman
*Assistant Examiner*—M. Chambers
(74) *Attorney, Agent, or Firm*—Brady O'Boyle & Gates

(57) ABSTRACT

A lacrosse stick string configuration, wherein a plurality of spaced, longitudinally extending thongs are connected to the top of the head of a lacrosse stick and to the base of the head. A plurality of longitudinally extending twisted cords are positioned in the spaces between the thongs, parallel thereto, and connected at opposite ends to the top of the head and the base of the head. Portions of the twisted cords extend transversely of the head to interconnect the longitudinal thongs and for maintaining the thongs in spaced relationship. The construction and arrangement of the thongs and twisted cords provide a relatively closed mesh pocket having rectangular openings for enhancing the control of the ball during catching, carrying, and throwing.

6 Claims, 2 Drawing Sheets

LACROSSE STICK STRING CONFIGURATION

BACKGROUND OF THE INVENTION

Various string configurations for lacrosse sticks have been proposed to enhance control of the ball. One such configuration is disclosed in U.S. Pat. No. 3,507,495, wherein four, spaced, longitudinal thong elements extend between, and are connected to, the head of the lacrosse stick and the base of the head adjacent the stop. A relatively open weave lacing extends transversely of the head to interconnect the longitudinal thongs and for maintaining the thongs in the spaced relationship. The string configuration thus forms a pocket for catching, carrying, and throwing the lacrosse ball.

While the above-noted string configuration has been satisfactory for its intended purpose, it has been characterized by a disadvantage in controlling the ball due to the open weave lacing.

After considerable research and experimentation, the lacrosse stick string configuration has been devised for improving the control of the lacrosse ball in catching, carrying, and throwing the ball.

SUMMARY OF THE INVENTION

The lacrosse stick string configuration of the present invention comprises, essentially, a plurality of spaced, longitudinally extending thongs connected to the top of the head of the lacrosse stick and to the base of the head. A plurality of longitudinally extending twisted cords are positioned in the spaces between the thongs, and are also connected to the top of the head and base of the head. Portions of the twisted cords extend transversely of the head to interconnect the longitudinal thongs and for maintaining the thongs in spaced relationship. By the construction and arrangement of the thongs and twisted cords, a relatively closed mesh pocket is formed having substantially rectangular openings or windows, whereby the control of the ball during catching, carrying, and throwing thereof is enhanced.

DESCRIPTION OF THE PREFERRED EMBODIMENT

Figure 1:
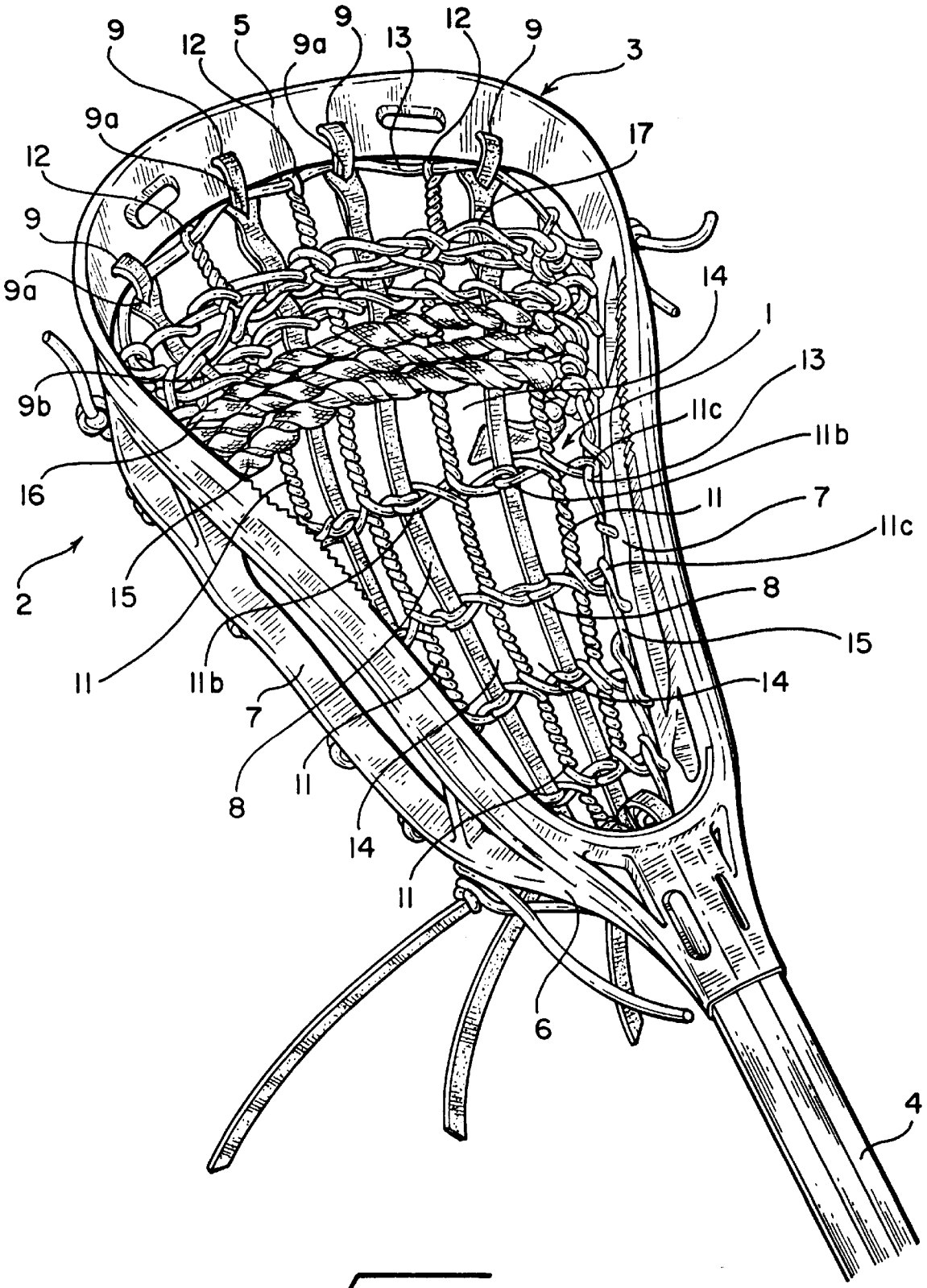
FIG. 1 is a perspective view of the front of a lacrosse showing the string configuration of the present invention.
Figure 2:
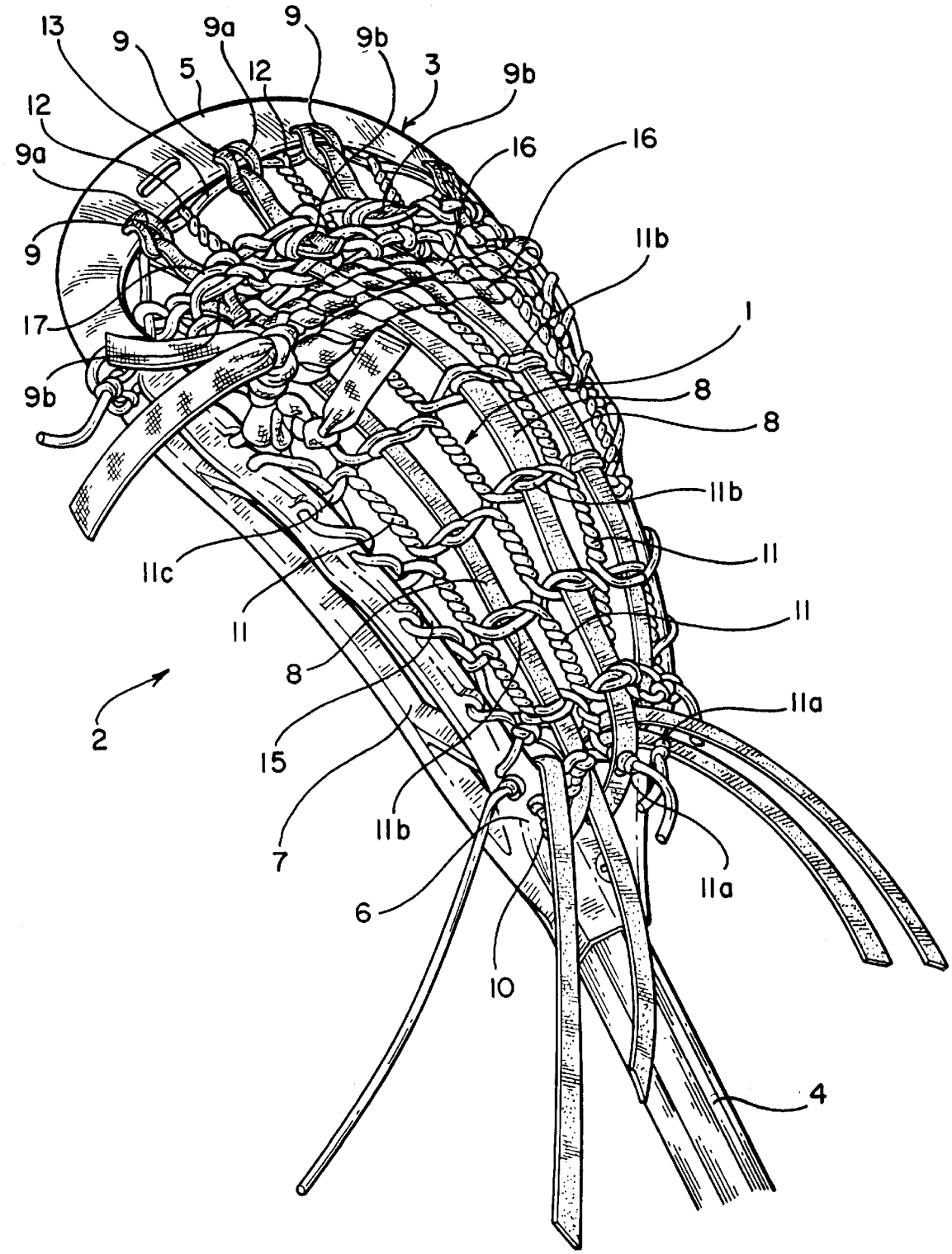
FIG. 2 is a perspective view of the rear of the lacross stick head and associated string configuration shown in FIG. 1.

Referring to FIGS. 1 and 2 of the drawings, the string configuration 1 of the present invention is adapted to be connected to a conventional lacrosse stick 2 having a head 3 and a handle 4. While the string configuration 1 of the present invention may be connected to various types of lacrosse sticks, it is shown connected to a BRINE® lacrosse stick, wherein the head 3 is of molded plastic having a top portion 5 and a base portion 6 interconnected by a pair of reinforced side walls 7.

The string configuration 1 comprises four, spaced, longitudinally extending leather thongs 8 connected to the top of the head 5 as at 9 and to the base 6 of the head as at 10. The connection 9 is obtained by providing the end of each thong 8 with a pair of longitudinally spaced slits 9*a* and 9*b*. The end of each thong 8 is inserted through apertures in the head top portion 5 from the front of the top portion 5 to the back, and the end of the thong 8 is then inserted through the slits 9*a* and 9*b*. The connection 10 is obtained by inserting the opposite end of each thong 8 through openings in the base portion 6 of the head 5.

A plurality of spaced, longitudinally extending ball control strings 11 are positioned in the spaces between the thongs 8. Each string 11 comprises a twisted nylon cord looped as at 12 around a transversely extending lacing 13 secured to opposite side walls 7 in proximity to the top portion of the head 5. The ends of the string 11 are inserted through a slit in the lower end of the thong 8 and held therein by a suitable knot 11*a*. Portions of the string 11 are wrapped around the thongs 8 as at 11*b* to provide transverse lacings for maintaining the thongs 8 in spaced relationship and to form rectangular openings or windows 14. The lateral ends of the transversely extending lacings of the string 11 are looped as at 11*c* around longitudinally extending cords 15 fastened to the side walls 7 of the head 5.

To complete the construction of the string configuration, shooting strings are provided by a plurality of twisted transversely extending fabric laces 16, intertwined with the strings 11 and thongs 8, and secured at each end to the longitudinally extending cords 15.

Transverse lacing 17, provided by a nylon cord interlaced or intertwined with itself and the thongs 8 and twisted strings 11, is secured at its opposite ends to the side wall 7 of the head, to thereby reinforce the string configuration.

From the above description, it will be appreciated by those skilled in the art that the construction and arrangement of the thongs 8 and twisted cords 11 and associated rectangular openings 12 provide an improved lacrosse stick string configuration, whereby the control of the ball during catching, carrying, and throwing thereof is enhanced.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. A string configuration for a lacrosse stick having a head provided with a top portion and a base portion interconnected by a pair of side walls, said string configuration comprising a plurality of spaced, longitudinally extending leather thongs, each leather thong having one end secured to the top portion of said head and another end secured to the base portion of the head, a plurality of spaced longitudinally extending strings positioned in the spaces between said thongs and parallel thereto, each string being a fabric cord twisted about itself, one end of each twisted string being connected to a transversely extending lacing secured to opposite side walls of said head, and said another end of each twisted string being connected to said another end of each thong.

2. The string configuration according to claim 1, wherein a plurality of longitudinally spaced, transversely extending cords are connected to the thongs and opposite side walls of said head, to thereby form rectangular openings defined by the thongs and transversely extending cords.

3. The string configuration according to claim 1, wherein portions of said twisted strings intermediate the ends thereof are wrapped around the thongs to provide transverse lacings for maintaining the thongs in spaced relationship and to form rectangular openings, whereby the control of the ball during catching, carrying, and throwing thereof is enhanced.

4. The string configuration according to claim 1, wherein each twisted string is looped around the transversely extending lacing.

5. The string configuration according to claim 1, wherein said another end of each twisted string extends through a slit in a respective thong and held therein by a knot on the end of said twisted string.

6. A string configuration for a lacrosse stick having a head provided with a top portion and a base portion interconnected by a pair of side walls, said string configuration comprising at least two spaced, longitudinally extending leather thongs, each leather thong having one end secured to the top portion of said head and another end secured to the base portion of the head, a longitudinally extending string positioned in the space between said thongs and parallel thereto, said string being a fabric cord twisted about itself, one end of said twisted string being connected to a transversely extending lacing secured to opposite side walls of said head, and said another end of said twisted string being connected to said another end of each thong.

* * * * *